US006938672B2

(12) United States Patent
Hong

(10) Patent No.: US 6,938,672 B2
(45) **Date of Patent: *Sep. 6, 2005**

(54) RHEOFORMING APPARATUS

(76) Inventor: Chun Pyo Hong, 108-502 Daerimhansuptown 1 Susaeck-dong, Eunpyung-gu, Seoul (KR)

( * ) Notice: Subject to any disclaimer, the term of this patent is extended or adjusted under 35 U.S.C. 154(b) by 138 days.

This patent is subject to a terminal disclaimer.

(21) Appl. No.: 10/606,183

(22) Filed: Jun. 26, 2003

(65) Prior Publication Data

US 2004/0211541 A1 Oct. 28, 2004

(30) Foreign Application Priority Data

Apr. 24, 2003 (KR) ..... 10-2003-0025997

(51) Int. Cl.[7] ..... B22D 17/10
(52) U.S. Cl. ..... 164/312; 164/900; 164/113
(58) Field of Search ..... 164/113, 312, 164/900

(56) References Cited

U.S. PATENT DOCUMENTS

| | | | | |
|---|---|---|---|---|
| 2,932,865 | A | * 4/1960 | Bauer | 164/113 |
| 3,948,650 | A | 4/1976 | Flemings et al. | |
| 4,229,210 | A | 10/1980 | Winter et al. | |
| 4,465,118 | A | 8/1984 | Dantzig et al. | |
| 4,694,881 | A | 9/1987 | Busk | |
| 6,079,477 | A | 6/2000 | Woodhouse | |
| 6,432,160 | B1 | 8/2002 | Lombard et al. | |
| 2003/0037900 | A1 | 2/2003 | Winterbottom | |

FOREIGN PATENT DOCUMENTS

| | | |
|---|---|---|
| EP | 0 779 119 A | 6/1997 |
| EP | 0 845 316 A1 | 6/1998 |
| FR | 2 665 654 A | 2/1992 |
| JP | 1-133692 | 5/1989 |
| JP | 05-225826 | 3/1995 |
| JP | 06-251148 | 3/1996 |
| JP | 07-062385 | 10/1996 |
| JP | 08-055695 | 9/1997 |
| JP | 08-283947 | 5/1998 |
| JP | 08-296420 | 5/1998 |
| JP | 10-128516 | 5/1998 |
| JP | 08-314329 | 6/1998 |
| JP | 08-317313 | 6/1998 |
| JP | 09-324294 | 8/1998 |
| JP | 09-119460 | 11/1998 |
| JP | 09-126671 | 12/1998 |
| JP | 09-198698 | 2/1999 |
| JP | 10-047921 | 9/1999 |
| JP | 2000-111666 | 11/2000 |
| JP | 11-155283 | 12/2000 |
| JP | 11-160487 | 12/2000 |
| JP | 11-166816 | 12/2000 |
| WO | WO 01/91945 A | 12/2001 |

* cited by examiner

*Primary Examiner*—Jonathan Johnson
*Assistant Examiner*—Len Tran
(74) *Attorney, Agent, or Firm*—Rothwell, Figg, Ernst & Manbeck

(57) ABSTRACT

Provided is a rheoforming apparatus that ensures the manufacture of products with fine, uniform spherical particles, with improvements in energy efficiency and mechanical properties of the products, cost reduction, convenience of forming, and shorter manufacturing time. The apparatus includes a first sleeve, an end of which is formed with an outlet vent for releasing slurries; a second sleeve for receiving molten metals, an end of the second sleeve being hinge-connected to the other end of the first sleeve at a predetermined angle; a stirring unit for applying an electromagnetic field to an area of the second sleeve in which the molten metals are present; a plunger, which is inserted into the other end of the second sleeve to block the other end of the second sleeve for receiving the molten metals and to pressurize the slurries; and a forming unit, which is connected to the outlet vent of the first sleeve to form products with a predetermined shape using the slurries.

15 Claims, 11 Drawing Sheets

RHEOFORMING APPARATUS

BACKGROUND OF THE INVENTION

This application claims the priority of Korean Patent Application No. 2003-25997 filed on Apr. 24, 2003, in the Korean Intellectual Property Office, the disclosure of which is incorporated herein in its entirety by reference.

1. Field of the Invention

The present invention relates to a rheoforming apparatus, and more particularly, to a rheoforming apparatus for manufacturing products with a predetermined shape from semi-solid metallic slurries with a fine, uniform, spherical particle structure.

2. Description of the Related Art

Rheoforming refers to a process of manufacturing billets or final products from semi-solid metallic slurries having a predetermined viscosity through forming or forging. Semi-solid metallic slurries consist of spherical solid particles suspended in a liquid phase in an appropriate ratio, at temperature ranges corresponding to a semi-solid state. Thus, they can be transformed even by a little force due to their thixotropic properties and can be easily cast like a liquid due to their high fluidity.

Such rheoforming is closely related to thixoforming and thus is also expressed as rheoforming/thixoforming. Thixoforming refers to a process involving reheating billets manufactured through rheoforming back into semi-molten slurries and forming or forging the slurries to manufacture final products.

Such rheoforming/thixoforming is more advantageous than general forming processes using molten metals, such as die casting or squeeze-forming. Because semi-solid or semi-molten metallic slurries used in rheoforming/thixoforming are fluid at a temperature lower than molten metals, it is possible to lower the forming temperature, thereby ensuring an extended lifespan of the die. In addition, when semi-solid or semi-molten metallic slurries are extruded through a cylinder, turbulence is less likely to occur, and thus less air is incorporated during forming. Therefore, the formation of air pockets in final products is prevented. Besides, the use of semi-solid or semi-molten metallic slurries leads to reduced shrinkage during solidification, improved working efficiency, mechanical properties, and anti-corrosion, and lightweight products. Therefore, such semi-solid or semi-molten metallic slurries can be used as new materials in the fields of automobiles, airplanes, and electrical, electronic information communications equipment.

In conventional rheoforming, molten metals are stirred at a temperature lower than the liquidus temperature for cooling, to break up dendritic structures into spherical particles suitable for rheoforming, for example, by mechanical stirring, electromagnetic stirring, gas bubbling, low-frequency, high-frequency, or electromagnetic wave vibration, electrical shock agitation, etc.

For example, U.S. Pat. No. 3,948,650 discloses a method and apparatus for manufacturing a liquid-solid mixture. In this method, molten metals are vigorously stirred while being cooled for solidification. A semi-solid metallic slurry manufacturing apparatus disclosed in this patent uses a stirrer to induce flow of the solid-liquid mixture having a predetermined viscosity to break up dendritic crystalline structures or disperse broken dendritic crystalline structures in the liquid-solid mixture. In this method, dendritic crystalline structures formed during cooling are broken up and used as nuclei for spherical particles. However, due to generation of latent heat of solidification at the early stage of cooling, the method causes problems of low cooling rate, manufacturing time increase, uneven temperature distribution in a mixing vessel, and non-uniform crystalline structure. Mechanical stirring applied in the semi-solid metallic slurry manufacturing apparatus inherently leads to non-uniform temperature distribution in the mixing vessel. In addition, because the apparatus is operated in a chamber, it is difficult to continuously perform a subsequent process.

U.S. Pat. No. 4,465,118 discloses a method and apparatus for manufacturing semi-solid alloy slurries. This apparatus includes a coiled electromagnetic field application unit, a cooling manifold, and a die, which are sequentially formed inward, wherein molten metals are continuously loaded into the vessel, and cooling water flows through the cooling manifold to cool the outer wall of the die. In manufacturing semi-solid alloy slurries, molten metals are injected through a top opening of the die and cooled by the cooling manifold, thereby resulting in a solidification zone within the die. When a magnetic field is applied by the electromagnetic field application unit, cooling breaks up dendritic crystalline structures formed in the solidification zone. Finally, ingots are formed from the slurries and then drawn through the lower end of the apparatus. The basic technical idea of this method and apparatus is to break up dendrites after solidification by applying vibration thereto. However, many problems arise with this method, such as complicated processing and non-uniform particle structure. In the manufacturing apparatus, since molten metals are continuously supplied to form ingots, it is difficult to control the states of the metal ingots and the overall process. Moreover, prior to applying an electromagnetic field, the die is cooled using water, so that a great temperature difference exists between the peripheral and core regions of the die.

Other types of rheoforming/thixoforming known in the art are described later. However, all of the methods are based on the technical idea of breaking up dendrites after their formation, to generate nuclei of spherical particles. Therefore, problems as described above arise.

U.S. Pat. No. 4,694,881 discloses a method for manufacturing thixotropic materials. In this method, an alloy is heated to a temperature at which all metallic components of the alloy are present in a liquid phase, and the resulting molten metals are cooled to a temperature between their liquidus and solidus temperatures. Then, the molten metals are subjected to a shearing force in an amount sufficient to break up dendrites formed during the cooling of the molten metals to thereby manufacture the thixotropic materials.

Japanese Patent Application Laid-open Publication No. Hei. 11-33692 discloses a method of manufacturing metallic slurries for rheocasting. In this method, molten metals are supplied into a vessel at a temperature near their liquidus temperature or 50° C. above their liquidus temperature. Next, when at least a portion of the molten metals reaches a temperature lower than the liquidus temperature, i.e., at least a portion of the molten metals begins cooling below their liquidus temperature, the molten metals are subjected to a force, for example, ultrasonic vibration. Finally, the molten metals are slowly cooled into metallic slurries containing spherical particles. This method also uses a physical force, such as ultrasonic vibration, to break up the dendrites grown at the early stage of solidification. In this regard, if the casting temperature is greater than the liquidus temperature, it is difficult to form spherical particle structures and to rapidly cool the molten metals. Furthermore, this method leads to a non-uniform surface and core structures.

Japanese Patent Application Laid-open Publication No. Hei. 10-128516 discloses a casting method for thixotropic metals. This method involves loading molten metals into a vessel and vibrating the molten metals using a vibrating bar dipped in the molten metals to directly transfer a vibrating force to the molten metals. After forming a semi-solid and semi-liquid molten alloy, which contains nuclei, at a temperature range lower than its liquidus temperature, the molten alloy is cooled to a temperature at which it has a predetermined liquid fraction and then left stand from 30 seconds to 60 minutes to allow the nuclei to grow, thereby resulting in thixotropic metals. However, this method provides relatively large particles of about 100 $\mu$m, takes a considerably long processing time, and cannot be performed in a vessel larger than a predetermined size.

U.S. Pat. No. 6,432,160 discloses a method for making thixotropic metal is slurries. This method involves simultaneously controlling the cooling and the stirring of molten metals to form the thixotropic metal slurries. In detail, after loading molten metals into a mixing vessel, a stator assembly positioned around the mixing vessel is operated to generate a magnetomotive force sufficient to rapidly stir the molten metals in the vessel. Next, the molten metals are rapidly cooled by means of a thermal jacket, equipped around the mixing vessel, for precise temperature control of the mixing vessel and the molten metals. During cooling, the molten metals are continuously stirred in a manner such that when the solid fraction of the molten metals is low, a high stirring rate is provided, and when the solid fraction increases, a greater magnetomotive force is applied.

Most of the aforementioned conventional rheoforming/thixoforming methods and apparatuses use a shear force to break dendrites into spherical structures during a cooling process. Since a force such as vibration is applied after at least a portion of the molten metals is cooled below their liquidus temperature, latent heat is generated due to the formation of initial solidification layers. As a result, there are many disadvantages such as reduced cooling rate and increased manufacturing time. In addition, due to a non-uniform temperature between the inner wall and the center of the vessel, it is difficult to form fine, uniform spherical metal particles. Therefore, this structural non-uniformity of metal particles will be greater if the temperature of the molten metals loaded into the vessel is not controlled.

In order to solve these problems, the present inventor filed Korean Patent Application No. 2003-13515, titled "Die Casting Method and Apparatus for Rheocasting."

SUMMARY OF THE INVENTION

The present invention provides a rheoforming apparatus that ensures the manufacture of products with a fine, uniform, spherical particle structure, with improvements in energy efficiency and mechanical properties of the products, cost reduction, convenience of forming, and shorter manufacturing time.

The present invention also provides a rheoforming apparatus for manufacturing high quality semi-solid products within a short time, with improvement in durability reduction of constitutional elements of the apparatus and an energy loss due to pressurization.

In accordance with an aspect of the present invention, there is provided a rheoforming apparatus comprising: a first sleeve, an end of which is formed with an outlet vent for releasing slurries; a second sleeve for receiving molten metals, an end of the second sleeve being hingedly connected to the other end of the first sleeve at a predetermined angle; a stirring unit for applying an electromagnetic field to an area of the second sleeve in which the molten metals are present; a plunger, which is inserted into the other end of the second sleeve to block the other end of the second sleeve for receiving the molten metals and to pressurize the slurries; and a forming unit, which is connected to the outlet vent of the first sleeve to form products with a predetermined shape using the slurries.

According to specific embodiments of the present invention, the forming unit may be an extrusion unit provided with a transfer roller and a cooler. Alternatively, the forming unit may be a press-forming unit provided with a press die.

The rheoforming apparatus may further comprise a first temperature control element, which is installed around the first sleeve to adjust the temperature of the slurries pressurized toward the outlet vent.

The stirring unit may apply the electromagnetic field to the second sleeve prior to loading the molten metals into the second sleeve. Alternatively, the stirring unit may apply the electromagnetic field to the second sleeve simultaneously with or in the middle of loading the molten metals into the second sleeve.

Th stirring unit may apply-the electromagnetic field to the second sleeve until the molten metals in the second sleeve have a solid fraction of 0.001–0.7, preferably 0.001–0.4, and more preferably 0.001–0.1.

The molten metals in the second sleeve may be cooled until they have a solid fraction of 0.1–0.7.

The rheoforming apparatus may further comprise a second temperature control element, which is installed around the second sleeve to cool the molten metals in the second sleeve. This temperature control element may comprise at least one of a cooler and a heater, which are installed around the second sleeve. This temperature control element may cool the molten metals in the second sleeve at a rate of 0.2–5.0° C./sec, preferably 0.2–2.0° C./sec.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will be described more fully in the following exemplary embodiments of the invention with reference to the accompanying drawings.

A rheoforming apparatus according to the present invention is used to manufacture products with a predetermined shape using semi-solid slurries. Therefore, the rheoforming method as performed by the apparatus of the present invention will first be described with reference to FIG. 1.

Unlike the aforementioned conventional techniques, according to rheoforming performed by the apparatus of the present invention, molten metals are loaded in a sleeve to form slurries and then the slurries are press-formed. A lower pressure may be used for a forming process. In this case, molten metals are stirred by applying an electromagnetic field prior to the completion of loading the molten metals into the sleeve. In other words, electromagnetic stirring is performed prior to, simultaneously with, or in the middle of loading the molten metals into the sleeve, to prevent the formation of initial dendritic structures. The stirring process may be performed using ultrasonic waves instead of the electromagnetic field.

In detail, after an electromagnetic field is applied to a predetermined portion of the sleeve surrounded by a stirring unit, the molten metals are loaded in the sleeve. In this case, an electromagnetic field is applied at an intensity sufficient to stir the molten metals.

Figure 1:
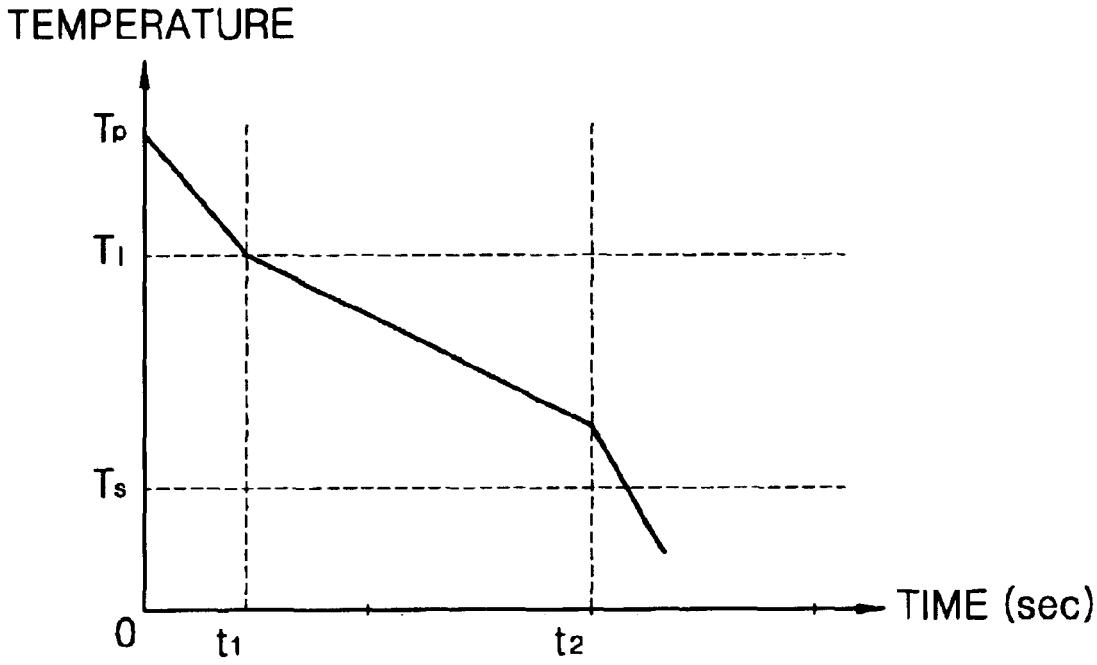
FIG. 1 is a graph of a temperature profile applied to a rheoforming apparatus according to the present invention.

As shown in FIG. 1, the molten metals are loaded into the sleeve at a temperature Tp. As described above, an electromagnetic field may be applied to the sleeve prior to loading the molten metals into the sleeve. However, the present invention is not limited to this, and electromagnetic stirring may be performed simultaneously with or in the middle of loading the molten metals into the sleeve.

Due to the electromagnetic stirring performed prior to the completion of loading the molten metals into the sleeve, the molten metals do not grow into dendritic structures near the inner wall of the low temperature sleeve at the early stage of solidification. That is, numerous micronuclei are concurrently generated throughout the sleeve because all the molten metals are rapidly cooled to a temperature lower than their liquidus temperature.

Applying an electromagnetic field to the sleeve prior to or simultaneously with loading the molten metals into the sleeve leads to active stirring of the molten metals in the center and inner wall regions of the sleeve and rapid heat transfer throughout the sleeve. Therefore, at the early stage of cooling, the formation of solidification layers near the inner wall of the sleeve is prevented. In addition, such active stirring of the molten metals induces smooth convection heat transfer between the higher temperature molten metals and the lower temperature inner sleeve wall. Therefore, the molten metals can be rapidly cooled. Due to the electromagnetic stirring, particles contained in the molten metals scatter upon loading the molten metals into the sleeve and are dispersed throughout the sleeve as nuclei, so that a temperature difference in the sleeve is not caused during cooling. However, in conventional techniques, when the molten metals come in contact with a low temperature inner vessel wall, solidification layers are formed near the inner wall of the vessel. As a result, dendrites are formed from the solidification layers.

The principles of the present invention will become more apparent when described in connection with solidification latent heat. The molten metals are not solidified near the inner sleeve wall at the early stage of cooling, and no solidification latent heat is generated. Accordingly, only the specific heat of the molten metals, which corresponds to about 1/400 of the solidification latent heat, is required to cool the molten metals. Therefore, dendrites, which are generated frequently near the inner sleeve wall at the early stage of cooling when using conventional methods, are not formed. All the molten metals in the sleeve can be uniformly cooled within merely about 1–10 seconds from the loading of the molten metals to the liquidus temperature. As a result, numerous nuclei are created and uniformly dispersed throughout all molten metals in the sleeve. The increased nuclei density reduces the distance between the nuclei, and spherical particles, instead of dendrites, are formed.

The same effects can be achieved even when an electromagnetic field is applied in the middle of loading the molten metals into the sleeve. In other words, solidification layers are hardly formed near the inner sleeve wall even when electromagnetic stirring begins in the middle of loading the molten metals into the sleeve.

It is preferable to limit the loading temperature, Tp, of the molten metals to a range from their liquidus temperature to 100° C. above the liquidus temperature (melt superheat= 0~100° C.). According to the present invention, since the entire sleeve containing the molten metals is uniformly cooled, there is no need to cool the molten metals to near their liquidus temperature prior to loading the molten metals into the sleeve. Therefore, it is possible to load the molten metals into the sleeve at a temperature of 100° C. above their liquidus temperature.

On the other hand, in one conventional method, after the completion of loading molten metals into a vessel, an electromagnetic field is applied to a vessel when a portion of the molten metals reaches below their liquidus temperature. Accordingly, at the early stage of cooling, latent heat is generated due to the formation of solidification layers near the inner wall of the vessel. Because the solidification latent heat is about 400 times greater than the specific heat of the molten metals, a significant time is required to drop the entire molten metals below their liquidus temperature. Therefore, in such a conventional method, the molten metals are generally loaded into a vessel after the molten metals are cooled to a temperature near their liquidus temperature or a temperature 50° C. above their liquidus temperature.

According to the present invention, the electromagnetic stirring may be stopped at any point after at least a portion of the molten metals in the sleeve reaches a temperature lower than the liquidus temperature $T_1$, i.e., after accomplishing nucleation for a solid fraction of a predetermined amount, such as about 0.001, as shown in FIG. 1. That is, an electromagnetic field may be applied to the molten metals in the sleeve throughout the cooling process of the molten metals. This is because, once nuclei are distributed uniformly throughout the sleeve, even at the time of growth of crystalline particles from the nuclei, properties of the metallic slurry are not affected by the electromagnetic stirring. Therefore, the electromagnetic stirring can be carried out only during the manufacture of metallic slurries, until a solid fraction of the molten metals is 0.001–0.7. However, in view of energy efficiency, it is preferable to carry out the electromagnetic stirring until a solid fraction of the molten metals is in the range of 0.001–0.4, and more preferably 0.001–0.1.

After loading the molten metals into the sleeve and forming uniformly distributed nuclei, the sleeve is cooled to facilitate the growth of the nuclei. In this regard, this cooling process may be performed simultaneously with loading of the molten metals into the sleeve. As described above, the electromagnetic field may be constantly applied during the cooling process.

Such a cooling process may be carried out until just prior to a subsequent process such as pressurizing and forming, and preferably, until a solid fraction of the molten metals is 0.1–0.7, i.e., up to time $t_2$ of FIG. 1. The molten metals may be cooled at a rate of 0.2–5.0° C./sec. The cooling rate may be 0.2–2.0° C./sec depending on a desired distribution of nuclei and a desired size of particles.

By using the aforementioned process, semi-solid metallic slurries containing a predetermined solid fraction can be easily manufactured. The manufactured semi-solid metallic slurries can be immediately subjected to extrusion and press-forming, simultaneously with pressurization.

According to the aforementioned process, semi-solid metallic slurries can be manufactured within a short time. That is, the manufacture of metallic slurries with a solid fraction of 0.1–0.7 merely occurs within 30–60 seconds from loading the molten metals into the sleeve. The manufactured metallic slurries can be used in forming products having a uniform, dense spherical crystalline structure.

Based on the aforementioned semi-solid slurry manufacture process, products with a predetermined shape can be manufactured using a rheoforming apparatus according to an embodiment of the present invention shown in FIGS. 2 through 10.

Figure 2:
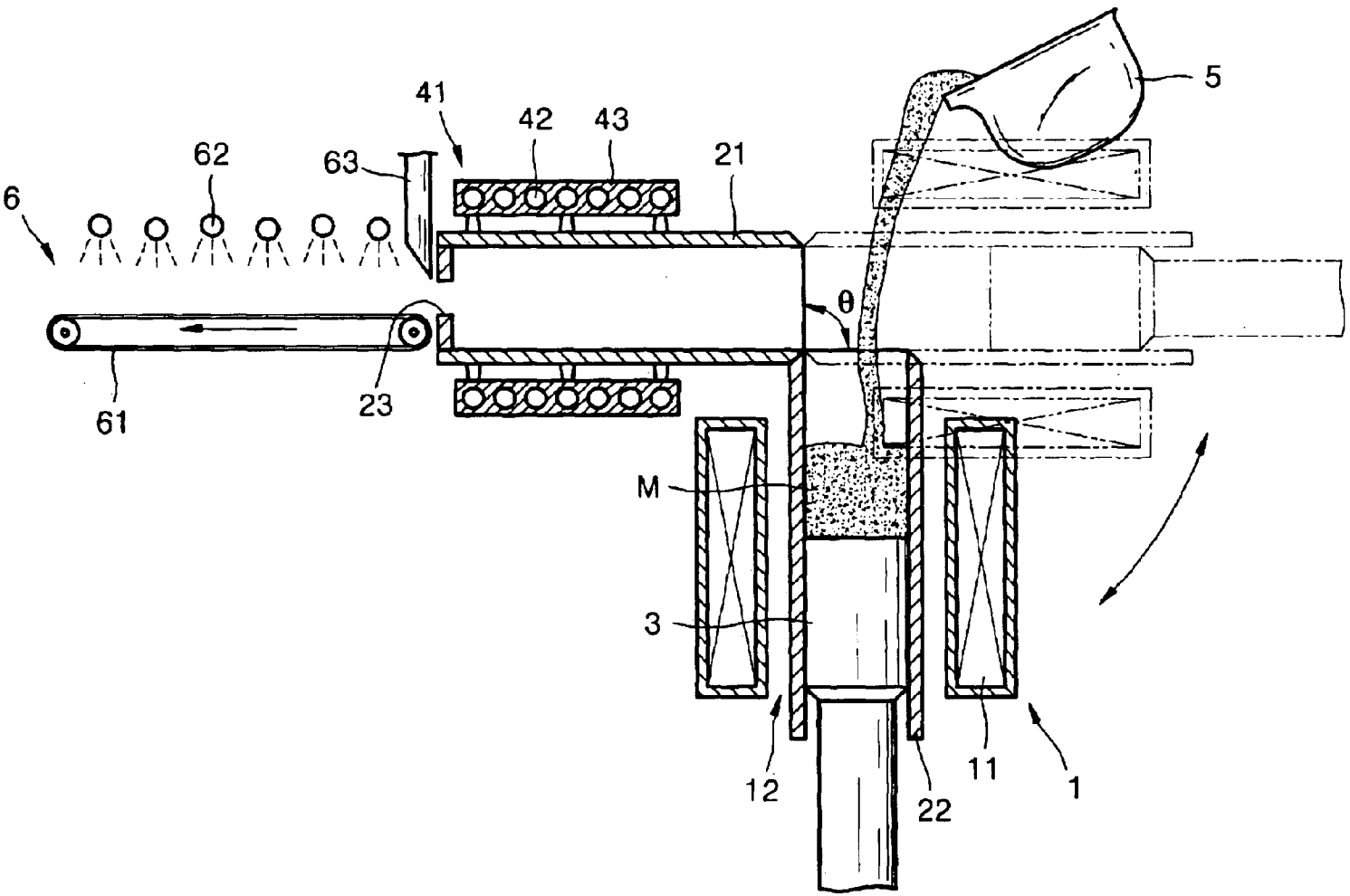
FIG. 2 illustrates a structure of a rheoforming apparatus according to an embodiment of the present invention.

A rheoforming apparatus according to the embodiment of the present invention as shown in FIG. 2 comprises an extrusion unit capable of forming into wires or sheets, and thus the rheoforming apparatus can be used as an extruder.

Such a rheoforming apparatus as shown in FIG. 2, used as an extruder, comprises a first sleeve 21 and a second sleeve 22; a stirring unit 1 for applying an electromagnetic field to at least an area of the second sleeve 22 in which molten metals are present; a first plunger 31 and a second plunger 32 for preparing slurries and pressurizing the prepared slurries to be transferred to a forming unit.

A coiled electromagnetic field application portion 11 is installed in the stirring unit 1 such as to surround a space 12 defined by the stirring unit 1. The space 12 and the coiled electromagnetic field application portion 11 may be fixed by means of a separate frame (not shown). The coiled electromagnetic field application portion 11 is used to apply a predetermined intensity of electromagnetic field to the second sleeve 22, which is accommodated in the space 12. Therefore, the molten metals contained in the second sleeve 22 are electromagnetically stirred. For this, the coiled electromagnetic field application portion 11 is electrically connected to a controller (not shown) for controlling the intensity of the electromagnetic field, its operating duration, etc. There are no particular limitations to the coiled electromagnetic field application portion 11, provided that the coiled electromagnetic field application portion 11 can be used in a conventional electromagnetic stirring process. An ultrasonic stirrer may also be used.

As shown in FIG. 2, the coiled electromagnetic field application portion 11 may be installed around the second sleeve 22 while in contact with the outside of the second sleeve 22 without leaving the space 12. By using the coiled electromagnetic field application portion 11, molten metals M can be thoroughly stirred while being loaded into the second sleeve 22. When the second sleeve 22 moves, the stirring unit 1 may move together with the second sleeve 22.

The application of an electromagnetic field, i.e., the electromagnetic stirring by the stirring unit 1, may be sustained until prepared semi-solid metallic slurries are pressurized. However, in view of energy efficiency, an electromagnetic field may be applied until slurries are manufactured, i.e., until a solid fraction of the slurries is 0.001–0.7. Preferably, the application of an electromagnetic field may be carried out until a solid fraction of the slurries is 0.001–0.4, and more preferably 0.001–0.1. The time required for accomplishing these solid fraction levels can be determined by previous experiments.

Turning to FIG. 2, the first sleeve 21 and the second sleeve 22 have opposed ends that are hinge-connected. The second sleeve 22 can move within an angle θ, preferably, less than 90 degrees with respect to the first sleeve 21. The first and second sleeves 21 and 22 may be made of a metallic material or an insulating material. It is preferable to use a material having a melting point higher than the molten metals M to be loaded into the sleeves 21 and 22. The two sleeves may be connected to each other in a state wherein both ends of each sleeve are open. The first sleeve 21 is positioned parallel to the ground and the second sleeve 22 is positioned at a predetermined angle with respect to the first sleeve 21.

In such a structure, the second sleeve 22 is an area for receiving molten metals and preparing slurries via electromagnetic stirring. On the other hand, the first sleeve 21 is an area for press-forming the prepared slurries. That is, the second sleeve 22 acts as a slurry manufacturing vessel for manufacturing semi-solid slurries using molten metals and the first sleeve 21 acts as a forming die for press-forming the manufactured slurries.

For this, the other end of the first sleeve 21 is formed with an outlet vent 23 for releasing pressurized slurries and a plunger 3 is inserted into the second sleeve 22.

The shape of the outlet vent 23 conforms to the shape of products to be manufactured. That is, if the products are of a wire form, a circular outlet vent is used, while if the products are of a sheet form, a rectangular outlet vent is used.

As shown in FIG. 2, the plunger 3, inserted into the other end of the second sleeve 22, is used to block the end of the second sleeve 22, so that the second sleeve 22 may receive the molten metals M.

It is not necessary to open both ends of each of the first and second sleeves 21, 22. There are no particular limitations to the structures of the sleeves. Although not shown in FIG. 2, a thermocouple may be installed in each sleeve and connected to a controller for providing temperature information to the controller.

The apparatus of the present invention may further comprise a first temperature control element 41, which is installed around the first sleeve 21, as shown in FIG. 2. The first temperature control element 41 may be a water jacket 43 containing a pipe 42, but is not limited thereto. Any temperature control elements capable of adjusting the temperature of a predetermined portion of the first sleeve 21 may be used. The first temperature control element 41 serves to prevent slurries pressurized in the first sleeve 21 from being rapidly cooled. In this regard, it is preferable that the first temperature control element 41 has a predetermined heat insulating function. By appropriately adjusting the temperature of a medium which flows in the pipe 42, the temperature of the slurries in the first sleeve 21 can be adjusted. An electric heater may also be used as the first temperature control element 41.

Figure 3:
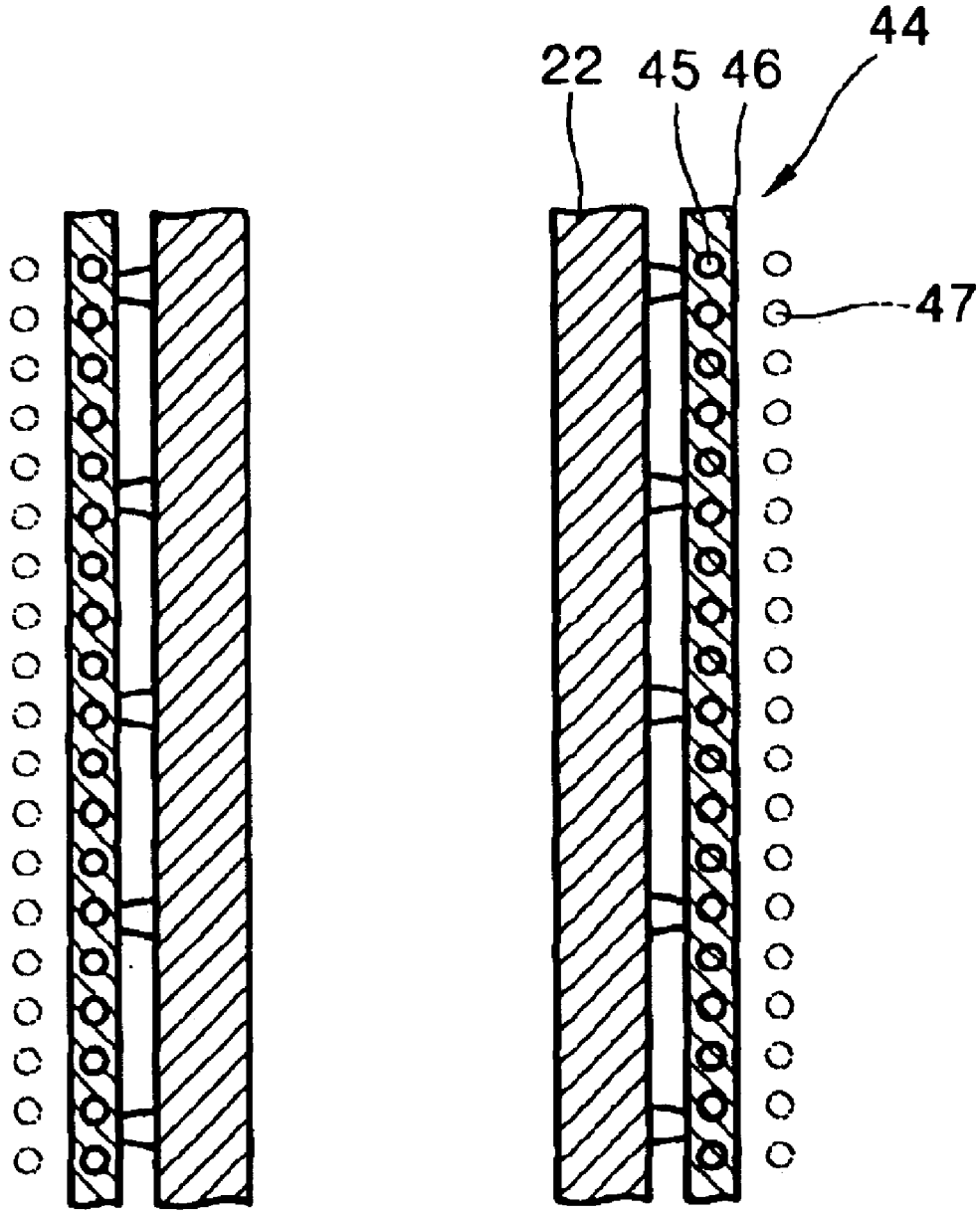
FIG. 3 is a sectional view of an example of a second sleeve used in a rheoforming apparatus according to the present invention.

The apparatus of the present invention may further comprise a second temperature control element 44, which is installed around the second sleeve 22, as shown in FIG. 3. The second temperature control element 44 is comprised of a cooler and a heater, which are installed around the second sleeve 22. In the embodiment of FIG. 3, a water jacket 46 containing a cooling water pipe 45 acts as the cooler and an electric heating coil 47 acts as the heater. The cooling water pipe 45 may be installed in a state of being buried in the second sleeve 22. Any coolers capable of cooling the molten metals M contained in the second sleeve 22 may be used. Also, any heating units except for the electric heating coil 47 may be used. There are no particular limitations to the structure of the second temperature control element 44, provided that the second temperature control element 44 can adjust the temperature of molten metals or slurries. The molten metals M contained in the second sleeve 22 can be cooled at an appropriate rate using the second temperature control element 44.

As shown in FIG. 3, the second temperature control element 44 may be installed around the entire second sleeve 22 or around the area in which the molten metals M are present.

The second temperature control element 44 may cool the molten metals M contained in the second sleeve 22 until a solid fraction of the molten metals M is 0.1–0.7. In this case, the cooling may be carried out at a rate of 0.2–5.0° C./sec, preferably 0.2–2.0° C./sec. As described above, the cooling may be carried out after the electromagnetic stirring or irrespective of the electromagnetic stirring, i.e., during the electromagnetic stirring. In addition, the cooling may be carried out simultaneously with the loading. The cooling may be carried out by any cooling units except for the second temperature control element 44. That is, the molten metals M contained in the second sleeve 22 may be spontaneously cooled without the aid of the second temperature control element 44.

The plunger 3 moves reciprocally like pistons in the first and second sleeves 21 and 22 while connected to a separate cylinder unit (not shown), which is in turn connected to a controller. While the electromagnetic stirring and cooling are carried out, i.e., during manufacturing slurries, the second sleeve 22 can act as a predetermined shaped vessel. When the second sleeve 22 is coupled with the first sleeve 21 after the completion of the slurry manufacture, the plunger 3 pushes the slurries toward the outlet vent 23.

An extrusion unit 6, which is installed outside the outlet vent 23, comprises a plurality of spray-type coolers 62 for cooling slurries extruded by pressurization of the plunger 3 and a transfer roller 61 for transferring the extruded slurries to a collection unit (not shown). Therefore, the extruded slurries in the form of a wire or a sheet can be rapidly cooled.

Hereinafter, operation of the rheoforming apparatus having the aforementioned structure according to an embodiment of the present invention will be described.

Turning to FIG. 2, the second sleeve 22 is hinge-connected to the first sleeve 21 at a predetermined angle, preferably 90 degrees. The lower part of the second sleeve 22 is blocked by the plunger 3 to allow the second sleeve 22 to act as a vessel for receiving molten metals. The coiled electromagnetic field application portion 11 of the stirring unit 1 applies an electromagnetic field having a predetermined frequency to the second sleeve 22 at a predetermined intensity. The coiled electromagnetic field portion 11 may apply an electromagnetic field with an intensity of 500 Gauss at 250 V and 60 Hz, but is not limited thereto. Any electromagnetic fields capable of being used in the electromagnetic stirring for the purpose of rheoforming may be applied.

In this state, metals M that have melted in a separate furnace are loaded via a loading unit 5 such as a ladle into the second sleeve 22 under an electromagnetic field. In this case, the furnace and the second sleeve 22 may be directly connected to each other for directly loading the molten metals M into the second sleeve 22. The molten metals M may be loaded into the second sleeve 22 at a temperature of 100° C. above their liquidus temperature. The second sleeve 22 may be connected to a separate gas supply tube (not shown) for supplying an inert gas such as $N_2$ and Ar, thereby preventing the oxidation of the molten metals M.

When the molten metals M are loaded into the second sleeve 22 under the electromagnetic stirring, fine, crystalline particles are distributed throughout the second sleeve 22, where they rapidly grow. Thus, the formation of dendrites is prevented.

An electromagnetic field may be applied simultaneously with or in the middle of the loading of the molten metals M, as described above.

The application of an electromagnetic field may be sustained until a slurry is pressurized, i.e., a solid fraction of the slurry is in the range of 0.001–0.7, preferably 0.001–0.4, and more preferably 0.001–0.1. The time required for accomplishing these solid fraction levels can be determined by previous experiments. The application of an electromagnetic field is carried out during so determined time.

After completion or in the middle of application of an electromagnetic field, the molten metals M in the second sleeve 22 are cooled at a predetermined rate until a solid fraction of the molten metals M is in the range of 0.1–0.7. In this case, the cooling may be carried out at a rate of 0.2–5.0° C./sec, preferably 0.2–2.0° C./sec, as described above. The time ($t_2$) required for accomplishing the solid fraction of 0.1–0.7 can be determined by previous experiments.

Figure 4:
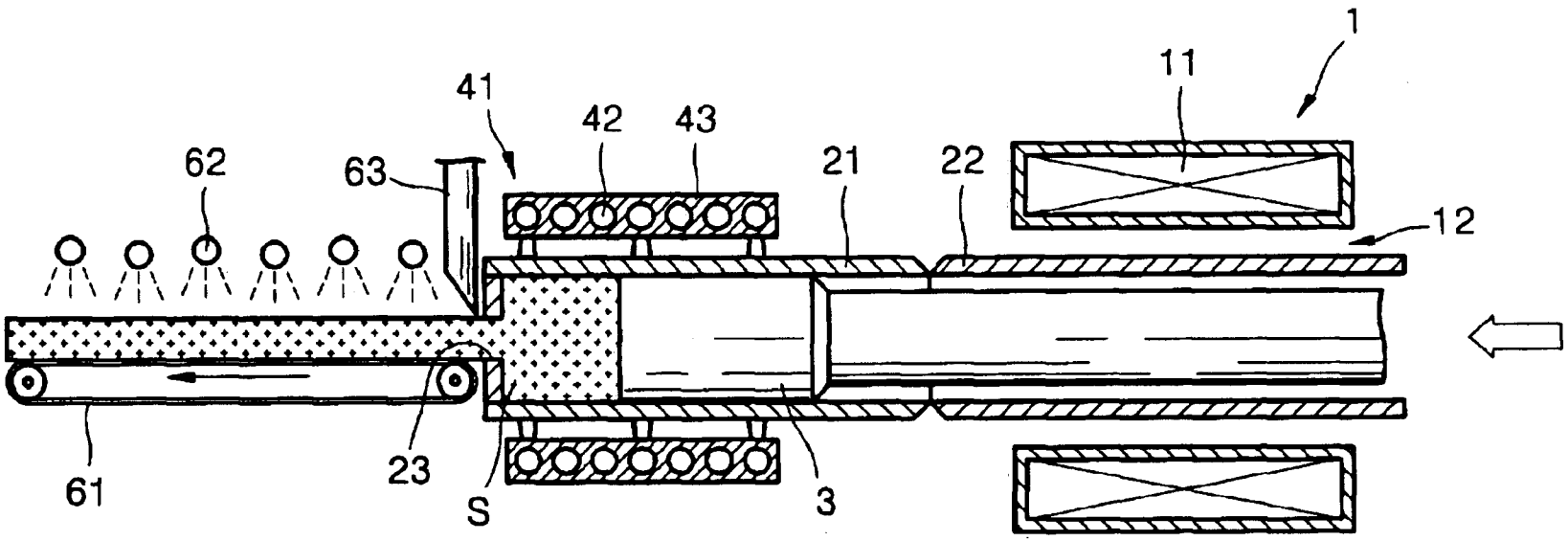
FIGS. 4 through 6 illustrate structures of a rheoforming apparatus for showing a sequential manufacturing process of extrudates according to the embodiment of the present invention as shown in FIG. 2.

After a semi-solid metallic slurry is manufactured, the second sleeve 22 is coupled with the fixed first sleeve 21 in a manner such that the second sleeve 22 moves at a predetermined angle, as shown in FIG. 4.

The plunger 3 pushes the slurry S toward the outlet vent 23 to release the slurry S into the extrusion unit 6 through the outlet vent 23. In this case, the temperature of the pressurized slurry can be adjusted by the first temperature control element 41, which is installed around the first sleeve 21.

Figure 5:
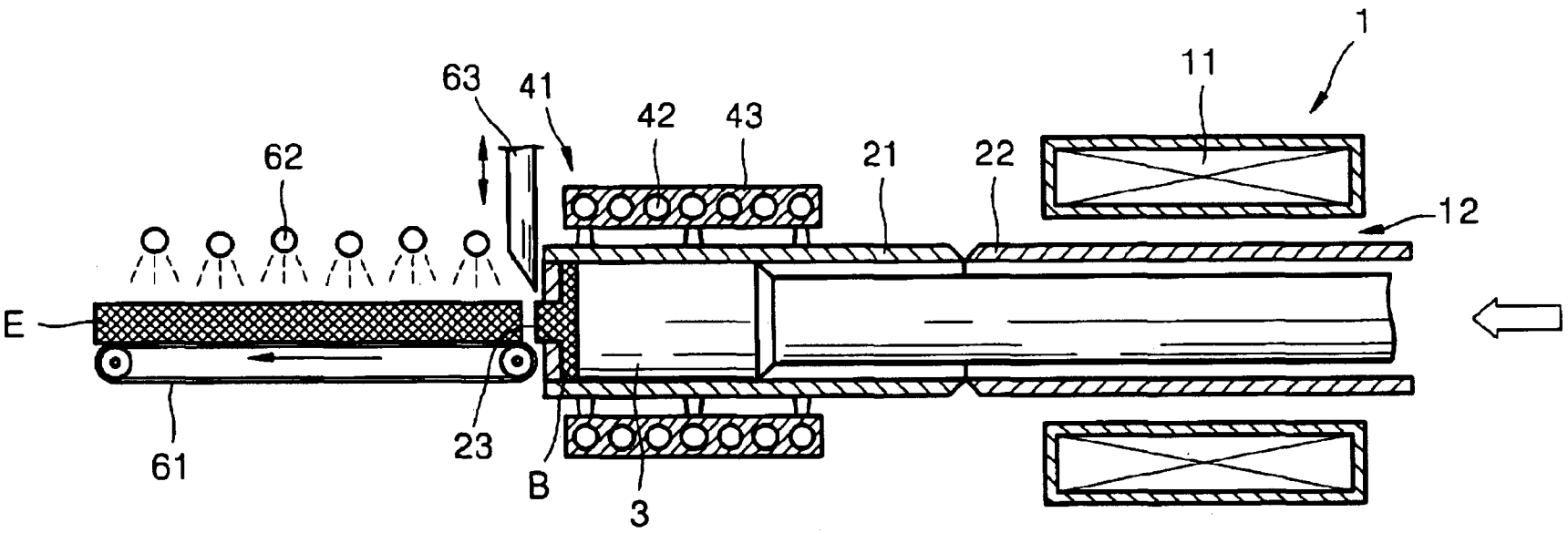

As shown in FIG. 5, the released slurry is transferred to a collection unit (not shown) by the transfer roller 61 while rapidly cooled by the coolers 62 of the extrusion unit 62. When the slurry cannot be released any more from the first sleeve 21, the released slurry, which is positioned between the extrusion unit 6 and the first sleeve 21, is cut by a cutter 63, which is positioned above the outlet vent 23, to thereby form an extrudate E.

Figure 6:
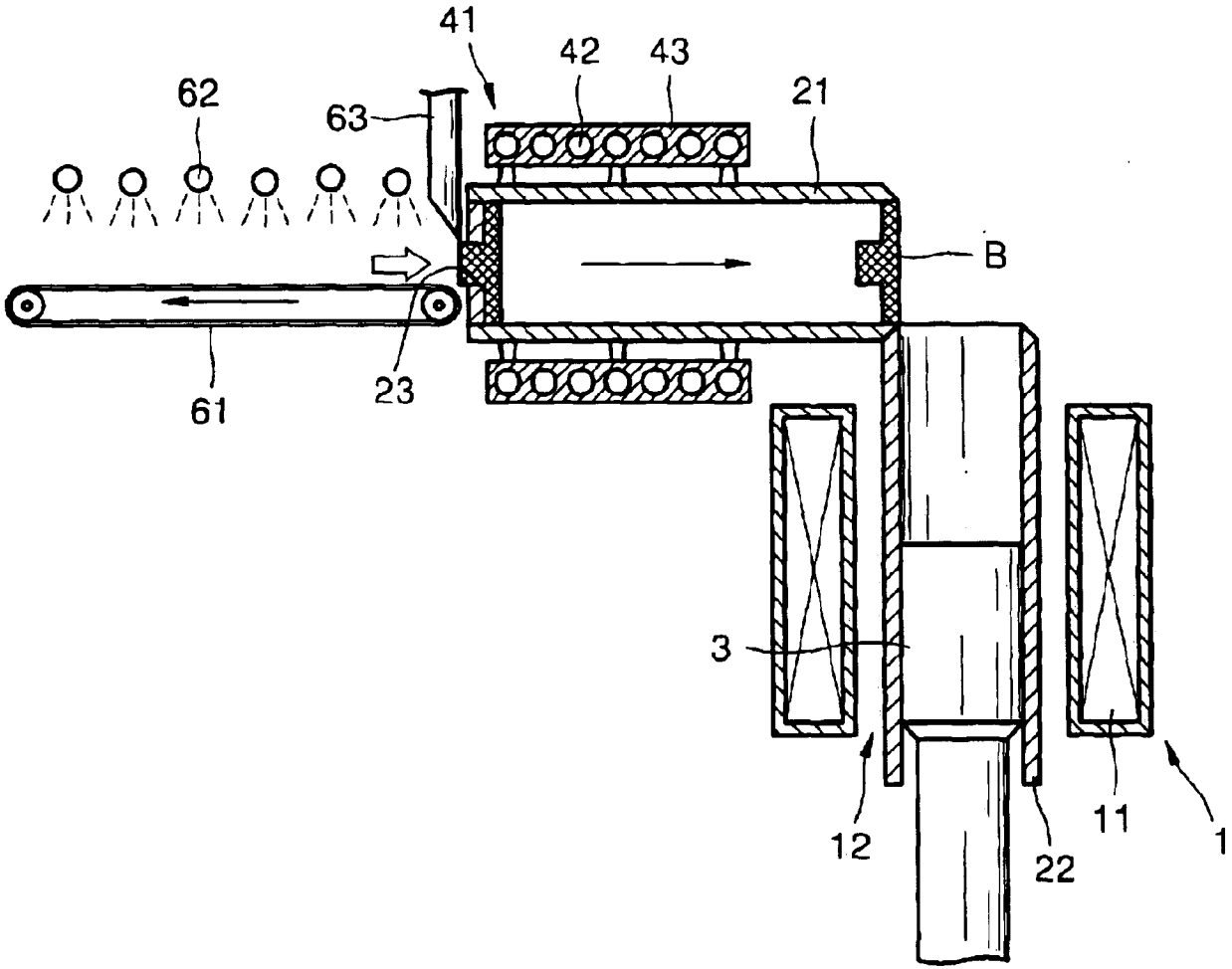

The extrudate E is transferred to the collection unit by the transfer roller 61. On the other hand, a biscuit B left in the first sleeve 21 is removed by a separate ejection unit after returning the plunger 3 to an original position and moving back the second sleeve 22 at a predetermined angle to open the end of the first sleeve 21, as shown in FIG. 6.

After the biscuit B is removed, the aforementioned process is repeated by loading molten metals into the second sleeve 22, as shown in FIG. 2. Therefore, extrudates with fine and uniform particle structures can be continuously manufactured.

According to this embodiment of the present invention, because molten metals are extruded in the form of slurries, high quality extrudates can be manufactured by using a low pressure. As a result, the loss of an electric energy and the operation duration can be reduced.

Figure 7:
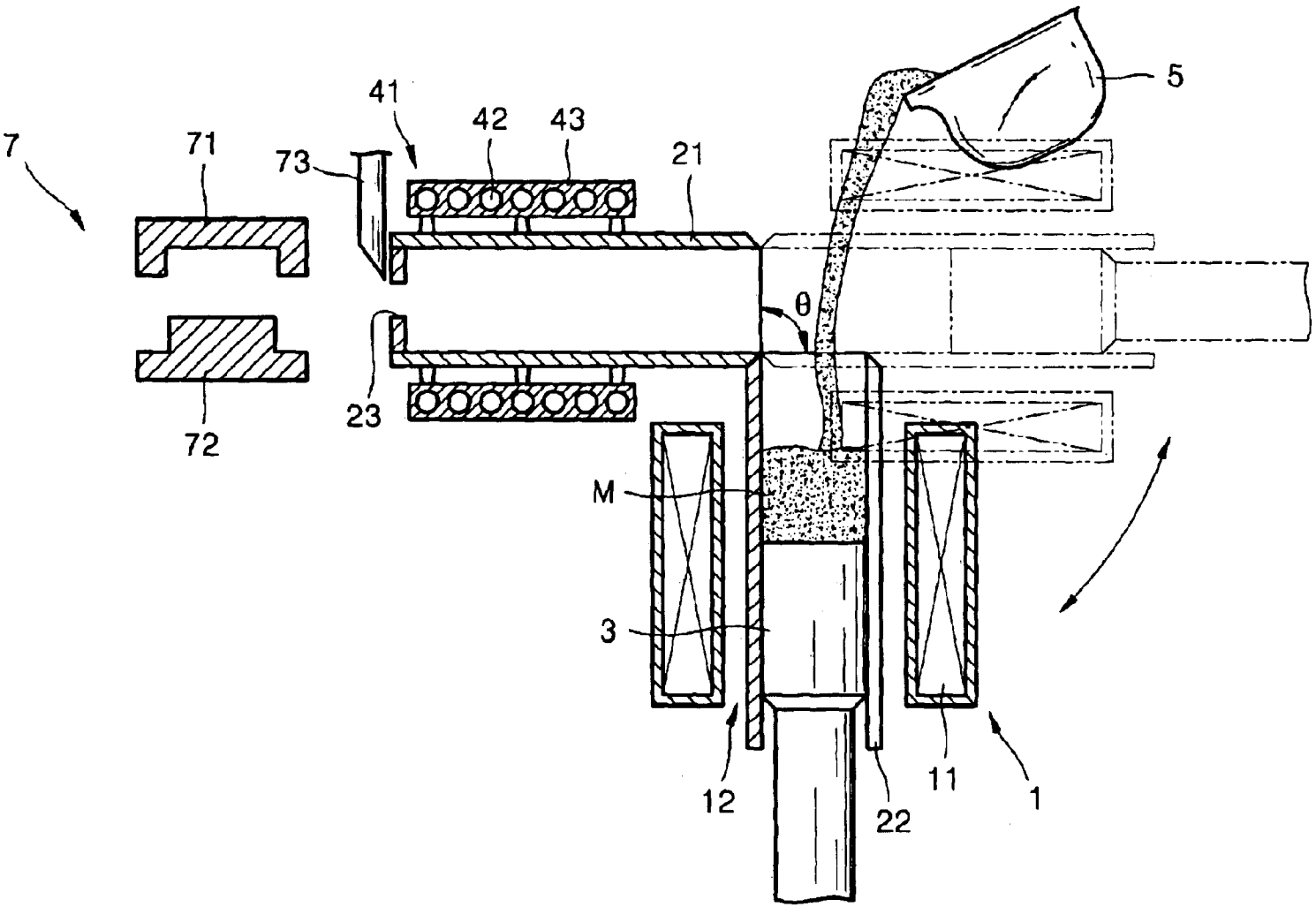
FIG. 7 illustrates a structure of a rheoforming apparatus according to another embodiment of the present invention.

According to another embodiment of the present invention, the aforementioned rheoforming apparatus can be used as a press-forming apparatus provided with a press-forming unit 7, as shown in FIG. 7. The rheoforming apparatus according to this embodiment of the present invention comprises a press-forming unit 7, which is formed with press dies 71 and 72 outside an outlet vent 23. The press-forming unit 7 forms a product with a shape conforming to the shape defined by the press dies 71, 72 using a slurry released from the outlet vent 23.

Figure 8:
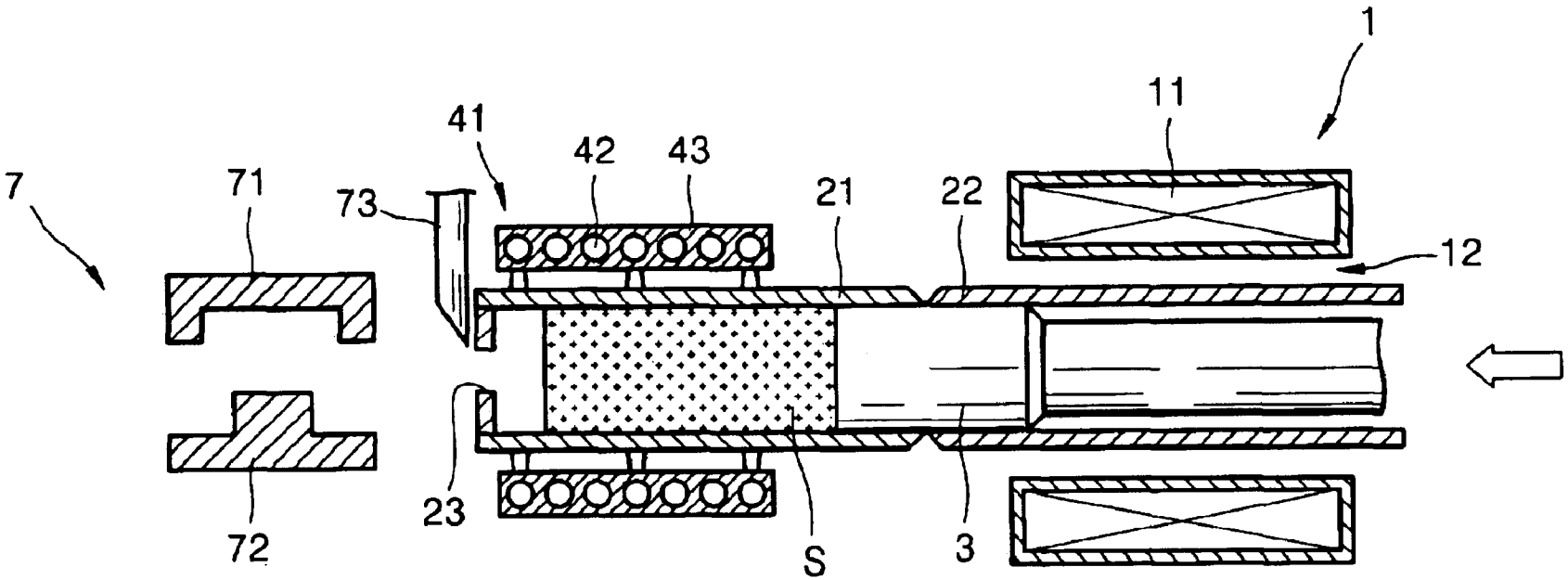
FIGS. 8 through 11 illustrate structures of a rheoforming apparatus for showing a sequential manufacturing process of press products according to the embodiment of the present invention as shown in FIG. 7.

First, a slurry is manufactured by loading molten metals M into a second sleeve 22, as shown in FIG. 7. Then, the second sleeve 22 is coupled with a first sleeve 21 and a plunger 3 pushes the slurry toward the outlet vent 23. In this case, the temperature of the slurry can be adjusted by a first temperature control element 41, which is installed around the first sleeve 21, as shown in FIG. 8.

Figure 9:
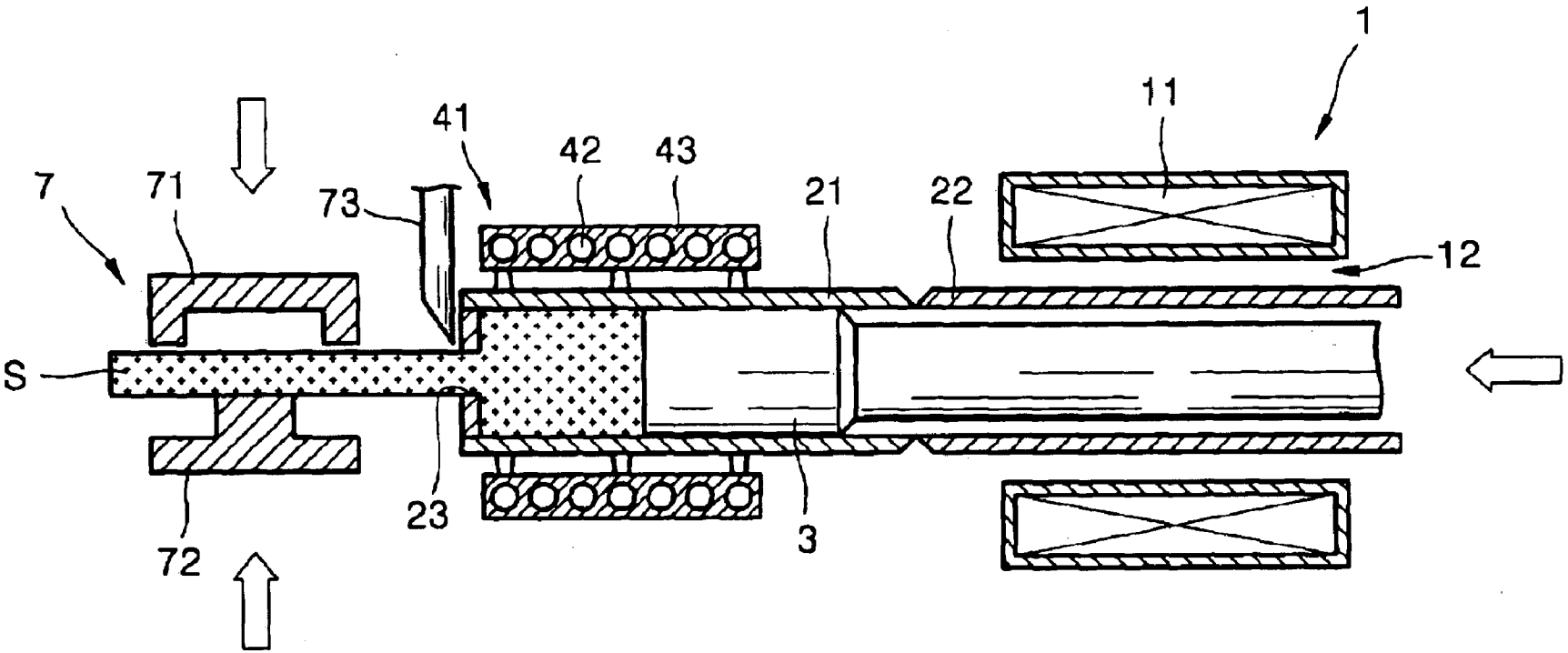
Figure 10:
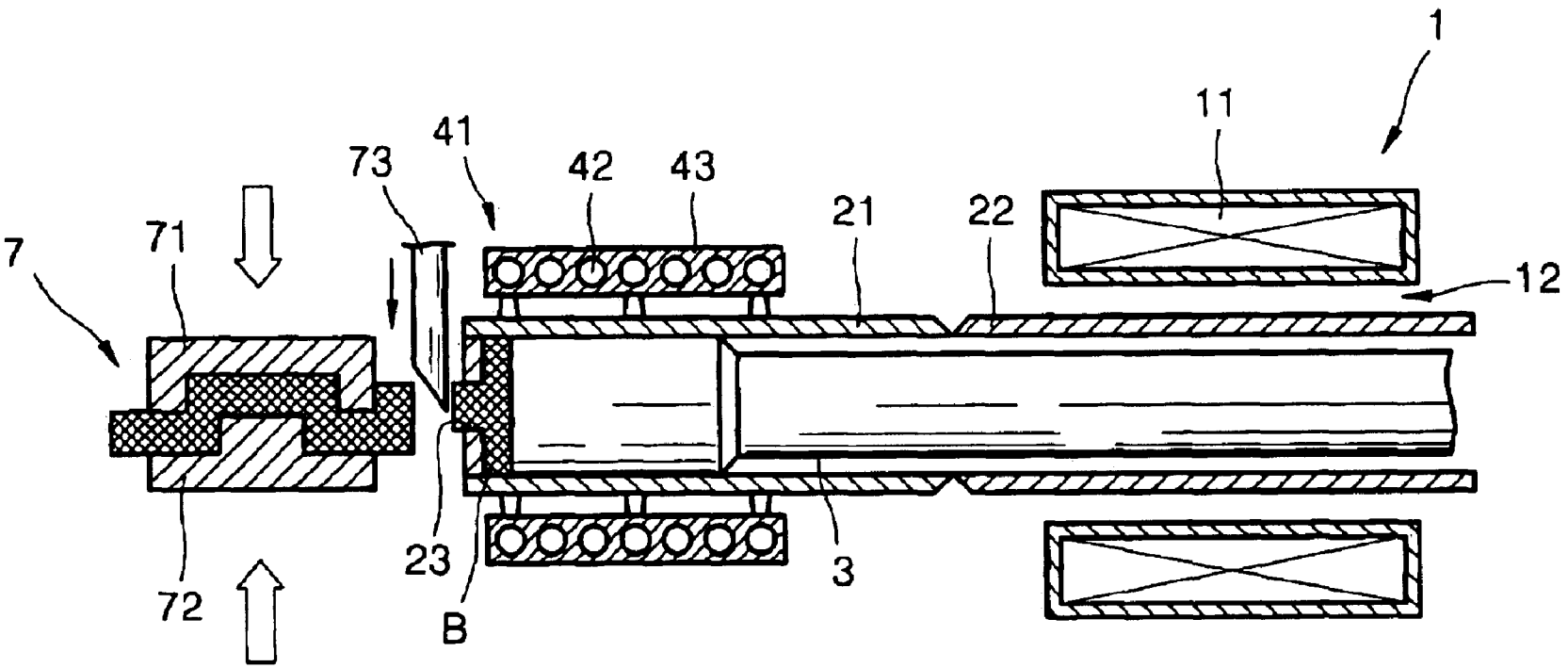

As shown in FIGS. 9 and 10, the slurry S released from the outlet vent 23 is pressurized by the press dies 71 and 72 to form a product with a predetermined shape. When the slurry S cannot be released any more from the first sleeve 21, the released slurry, which is positioned between the press-forming unit 7 and the first sleeve 21, is cut by a cutter 73, which is positioned above the outlet vent 23.

Figure 11:
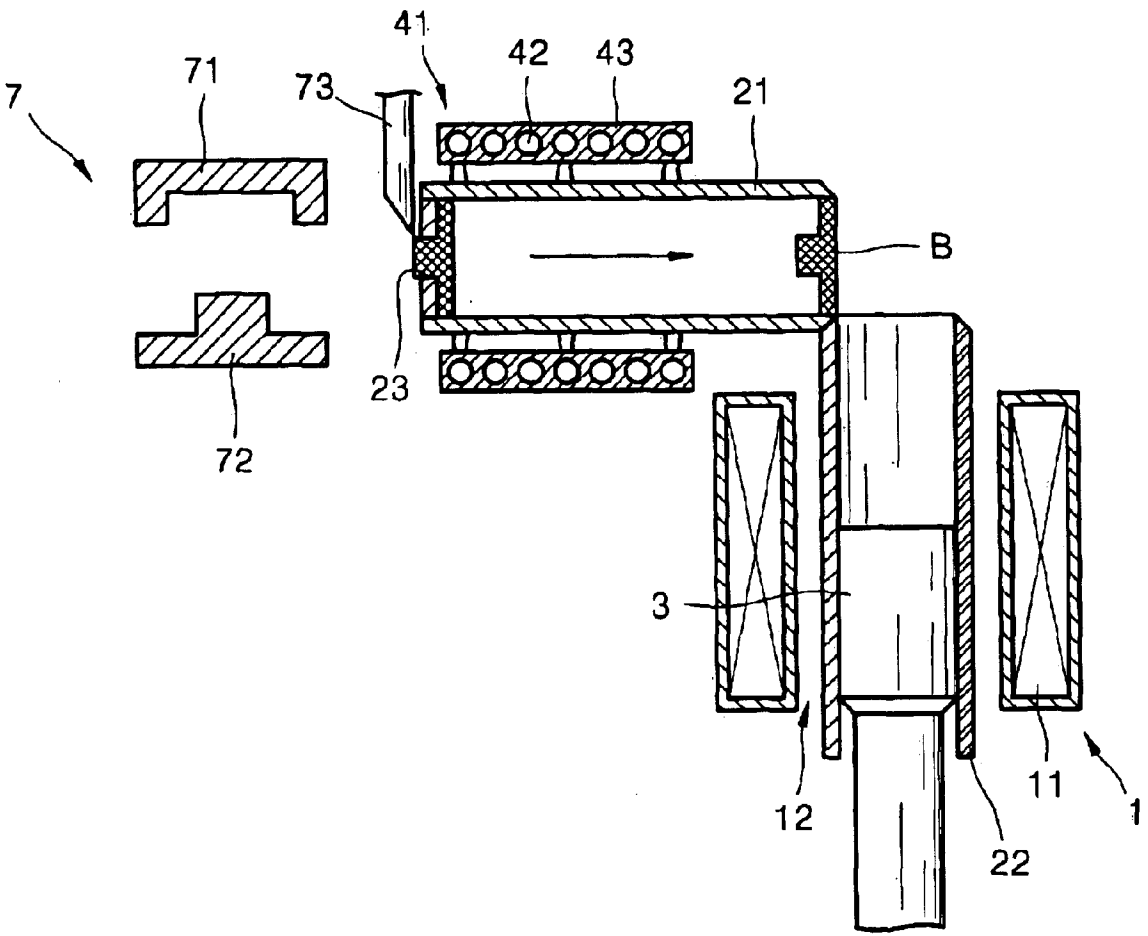

A biscuit B left in the first sleeve 21 is removed by a separate ejection unit after returning the plunger 3 to an original position and moving back the second sleeve 22 at a predetermined angle to open the end of the first sleeve 21, as shown in FIG. 11.

After the biscuit B is removed, the aforementioned process is repeated by loading molten metals into the second sleeve 22, as shown in FIG. 7. Therefore, products with fine and uniform particle structures can be continuously manufactured.

According to this embodiment of the present invention, because molten metals are subjected to press-forming in the form of slurries, high quality products can be manufactured by using a low pressure. As a result, the loss of an electric energy and the operation duration can be reduced.

A rheoforming apparatus according to the present invention can be widely used for rheoforming of various kinds of metals and alloys, for example, aluminum, magnesium, zinc, copper, iron, and an alloy thereof.

As apparent from the above descriptions, a rheoforming apparatus according to the present invention provides the following effects.

First, products having a uniform, fine, and spherical particle structure can be manufactured.

Second, spherical particles can be formed within a short time through electromagnetic stirring at a temperature above the liquidus temperature of molten metals to thereby generate more nuclei at an inner sleeve wall.

Third, the manufactured products have improved mechanical properties.

Fourth, the duration of electromagnetic stirring is greatly shortened, thereby conserving a stirring energy.

Fifth, the simplified overall process and the reduced forming duration improve productivity.

Sixth, because the products are formed from slurries, a lower pressure can be used, when compared to a conventional forming method using a solid such as press forming, forging, and extrusion.

Seventh, because the products are formed under a low pressure, durability of constitutional elements of the apparatus can be improved, and energy loss and manufacture duration can be reduced.

Eighth, because the products are formed under a low pressure, complex shaped or thinner shaped products can be easily formed.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A rheoforming apparatus, comprising:

a first sleeve, an end of which is formed with an outlet vent for releasing slurries;

a second sleeve for receiving molten metals, an end of the second sleeve being hinge-connected to the other end of the first sleeve at a predetermined angle;

a stirring unit for applying an electromagnetic field to an area of the second sleeve in which the molten metals are present;

a plunger, which is inserted into the other end of the second sleeve to block the other end of the second sleeve for receiving the molten metals and to pressurize the slurries; and a forming unit, which is connected to the outlet vent of the first sleeve to form products with a predetermined shape using the slurries.

2. The rheoforming apparatus according to claim 1, wherein the forming unit is an extrusion unit provided with a transfer roller and a cooler.

3. The rheoforming apparatus according to claim 1 ,wherein the forming unit is a press-forming unit provided with a press die.

4. The rheoforming apparatus according to claim 1, further comprising a first temperature control element, which is installed around the first sleeve to adjust the temperature of the slurries pressurized toward the outlet vent.

5. The rheoforming apparatus according to claim 1, wherein the stirring unit applies the electromagnetic field to the second sleeve prior to loading the molten metals into the second sleeve.

6. The rheoforming apparatus according to claim 1, wherein the stirring unit applies the electromagnetic field to the second sleeve simultaneously with loading the molten metals into the second sleeve.

7. The rheoforming apparatus according to claim 1, wherein the stirring unit applies the electromagnetic field to the second sleeve in the middle of loading the molten metals into the second sleeve.

8. The rheoforming apparatus according to claim 1, wherein the stirring unit applies the electromagnetic field to the second sleeve until the molten metals in the second sleeve have a solid fraction, of 0.001–0.7.

9. The rheoforming apparatus according to claim 8, wherein the stirring unit applies the electromagnetic field to the second sleeve until the molten metals in the second sleeve have a solid fraction of 0.001–0.4.

10. The rheoforming apparatus according to claim 9, wherein the stirring unit applies the electromagnetic field to the second sleeve until the molten metals in the second sleeve have a solid fraction of 0.001–0.1.

11. The rheoforming apparatus according to claim 1, wherein the molten metals in the second sleeve is cooled until the molten metals have a solid fraction of 0.1–0.7.

12. The rheoforming apparatus according to claim 11, further comprising a second temperature control element, which is installed around the second sleeve to cool the molten metals in the second sleeve.

13. The rheoforming apparatus according to claim 12, wherein the second temperature control element comprises at least one of a cooler and a heater, which are installed around the second sleeve.

14. The rheoforming apparatus according to claim 12, wherein the second temperature control element cools the molten metals in the second sleeve at a rate of 0.2–5.0/sec.

15. The rheoforming apparatus according to claim 14, wherein the second temperature control element cools the molten metals in the second sleeve at a rate of 0.2–2.0/sec.

* * * * *